US007210543B1

(12) United States Patent
Sumner

(10) Patent No.: US 7,210,543 B1
(45) Date of Patent: May 1, 2007

(54) REVERSIBLE POWER TAKEOFF DRIVEN POST HOLE DIGGER

(76) Inventor: James B Sumner, P. O. Box 343, New Market, AL (US) 35761

( * ) Notice: Subject to any disclaimer, the term of this patent is extended or adjusted under 35 U.S.C. 154(b) by 170 days.

(21) Appl. No.: 11/059,997

(22) Filed: Feb. 17, 2005

Related U.S. Application Data

(60) Provisional application No. 60/580,482, filed on Jun. 17, 2004.

(51) Int. Cl.
*E21B 10/44* (2006.01)
*F16H 3/00* (2006.01)

(52) U.S. Cl. ..... 175/323; 175/394; 74/324

(58) Field of Classification Search ..... 175/323, 175/394; 74/324, 322
See application file for complete search history.

(56) References Cited

U.S. PATENT DOCUMENTS

| | | | | | |
|---|---|---|---|---|---|
| 1,427,374 | A * | 8/1922 | Glass | 74/137 |
| 1,628,233 | A * | 5/1927 | Daniel | 74/324 |
| 1,633,060 | A * | 6/1927 | Baumberger | 74/35 |
| 1,690,746 | A * | 11/1928 | Mitchinson | 74/324 |
| 2,230,757 | A | 2/1941 | Long | |
| 2,273,203 | A * | 2/1942 | Keene et al. | 173/26 |
| 2,592,402 | A * | 4/1952 | Erdahl | 173/26 |
| 3,252,523 | A * | 5/1966 | Kachnik et al. | 172/445.2 |
| 3,407,888 | A * | 10/1968 | Graipin | 175/173 |
| 3,976,147 | A * | 8/1976 | Cunningham | 173/185 |
| 4,601,348 | A | 7/1986 | Cox | |
| 6,725,950 | B2 | 4/2004 | Palm | |
| 2002/0020563 | A1 * | 2/2002 | Baka | 175/122 |

* cited by examiner

*Primary Examiner*—Jennifer H. Gay
*Assistant Examiner*—Robert Fuller
(74) *Attorney, Agent, or Firm*—Mark Clodfelter

(57) ABSTRACT

A reversible post hole digger apparatus powered by a power takeoff shaft includes a transmission providing a reverse gear and a forward gear in a single housing. The apparatus has a power head disposed between a shaft connected to the power takeoff and an output shaft driving an auger. A gear box within the power head contains a main shaft which carries forward and reverse pinion gears at opposite ends and has a central portion with an external spline connector. The pinion gears are activated by a central spline-containing slide. Movement of the slide, carried out by means of a shift lever engaging a fork with a rack and pinion device, provides connection to forward, reverse and neutral positions on the shaft. Upper and lower ring gears drive an output shaft in a selected direction.

20 Claims, 7 Drawing Sheets

REVERSIBLE POWER TAKEOFF DRIVEN POST HOLE DIGGER

CROSS REFERENCE TO RELATED APPLICATION

This application claims the benefit of applicant's provisional application Ser. No. 60/580,482, filed Jun. 17, 2004.

FIELD OF THE INVENTION

This invention relates to motorized post hole diggers, and more particularly to post hole diggers driven by a power takeoff and provided with a capability for reversing the direction of rotation of an auger used to dig the hole.

BACKGROUND OF THE INVENTION

Post hole diggers mounted on a three-point hitch of a tractor and connected to the tractor power takeoff are highly effective in digging post holes, but inclusion of a mechanism to reverse rotation of the auger is needed in case underground obstacles such as strong roots or rocks are encountered. Various approaches have been taken, including use of a kit or adapter including a gear transmission providing forward and reverse capability, with this mechanism being placed outside of the power head of the system. It is desired to include a reversing mechanism within the power head, with this mechanism being self-contained in a common housing or case, so that such capability is provided for in initial design and manufacturing steps.

SUMMARY OF THE INVENTION

The present invention is directed to a self-contained, reversible post hole digger apparatus providing for forward and reverse action of the digging auger, effective for augers propelled by a power takeoff of a tractor or other power source. The apparatus includes a power head disposed between a main shaft connected to a power takeoff of a tractor, a supporting boom and an output shaft connected to an auger. A gear box is located within the power head, the gear box comprising a case carrying the main shaft, which extends across and is supported by antifriction bearings on each side of the case. A central portion of the main shaft is provided with splines. Forward and reverse pinion gears are mounted for rotation on the main shaft on each side of the splined portion, each of the pinions provided with an external splined region. The pinions in turn simultaneously and permanently engage an upper ring gear and a lower ring gear. This arrangement compensates for thrust developed between a pinion gear and a single ring gear that tends to wear out bearings of a shaft to which the pinion is mounted. A slide having an internal splined region matching the splines of the central portion of the main shaft is slidably fitted on the splined portion of the main shaft, the slide being movable on the main shaft from a neutral position in the center to a position bridging the splines of the main shaft and the splines of a selected pinion, the selected, bridged pinion determining a forward or reverse direction of the auger. Movement of the slide is carried out by engagement with a fork actuated with a rack and pinion subassembly controlled by a gear shift lever. The lower ring gear is coupled to the output shaft which is driven either forward or in reverse, depending on which end of the slide has been engaged with the respective pinion. Bearings and seals are provided at each end of the shafts and elsewhere as required.

DESCRIPTION OF THE PREFERRED EMBODIMENTS

Figure 1:
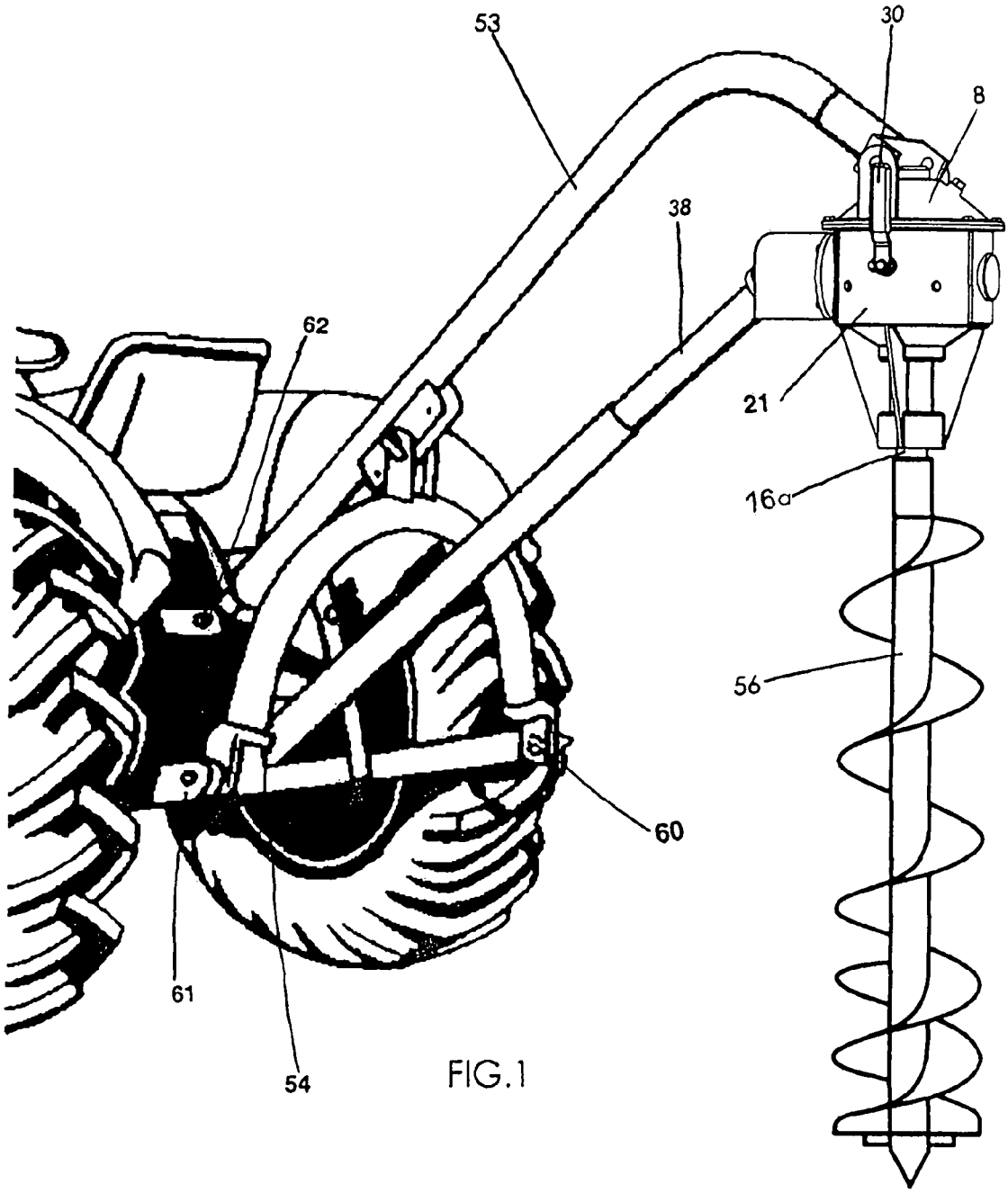
FIG. 1 is a rear view showing a power head equipped with a gear box and driven by a power takeoff of a tractor.

Referring to FIG. 1 of the drawings, there is shown a power head/gear box case 21 having a top cover 8 and mounted on a boom 53 which is connected to a three point hitch 60, 61, 62 of a tractor. An input shaft 38 is connected to a power takeoff shaft 54 provided by the tractor. A gear shift handle 30 controls the direction of rotation of the output shaft 16*a*, which drives auger 56.

Figure 2:
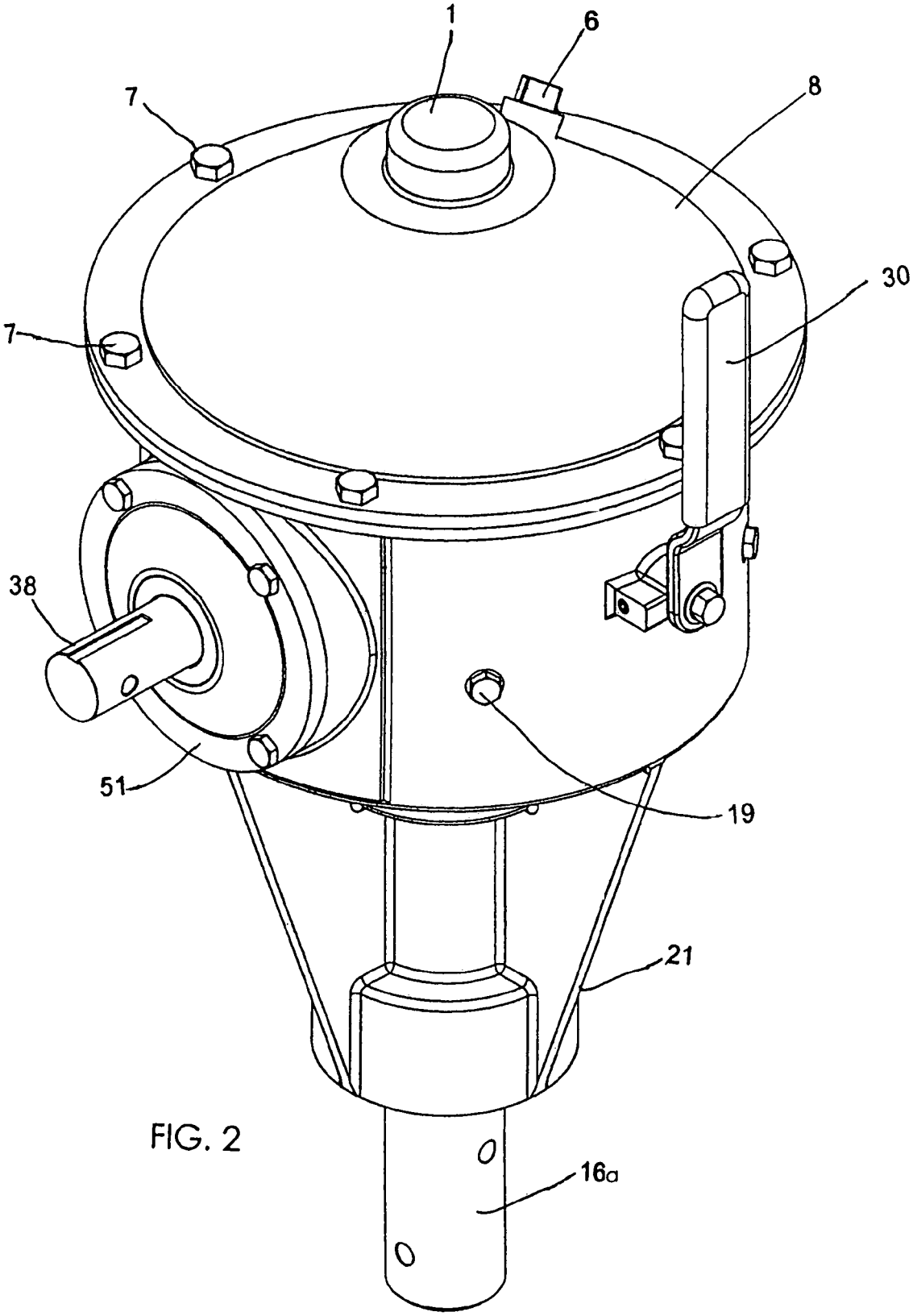
FIG. 2 is an external view of a power head containing a gear box.

External features of the gear box are shown in FIG. 2. The case has a top cover 8 and a dust cover 1 at the center of the top cover. Bolts 7 secure the top in place. Input shaft 38 extends outward through a front cover 51. An oil fill plug 6 is disposed at the top, and an oil check plug 19 is at a side location. Output shaft 16 extends downward from the bottom of supporting gussets 21.

Figures 3A, 3B, 3C:
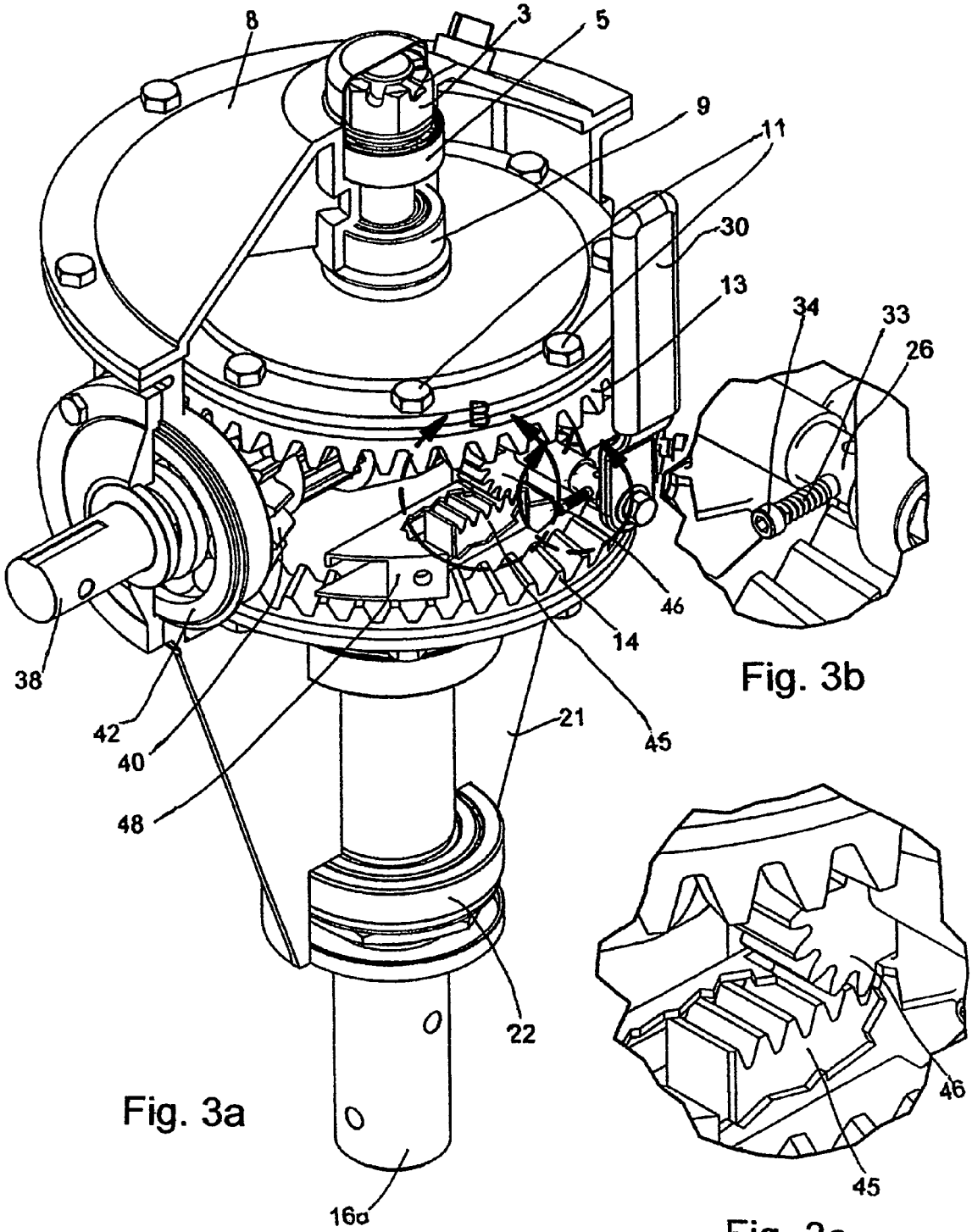
FIG. 3*a* is a cut-away view taken from a point above and to a power takeoff side of a power head portion of my new reversible post hole digger and showing construction details thereof.
FIG. 3*b* is a partial view showing construction details of my new reversible post hole digger.
FIG. 3*c* is a partial view showing construction details of my new reversible post hole digger.
Figure 4:
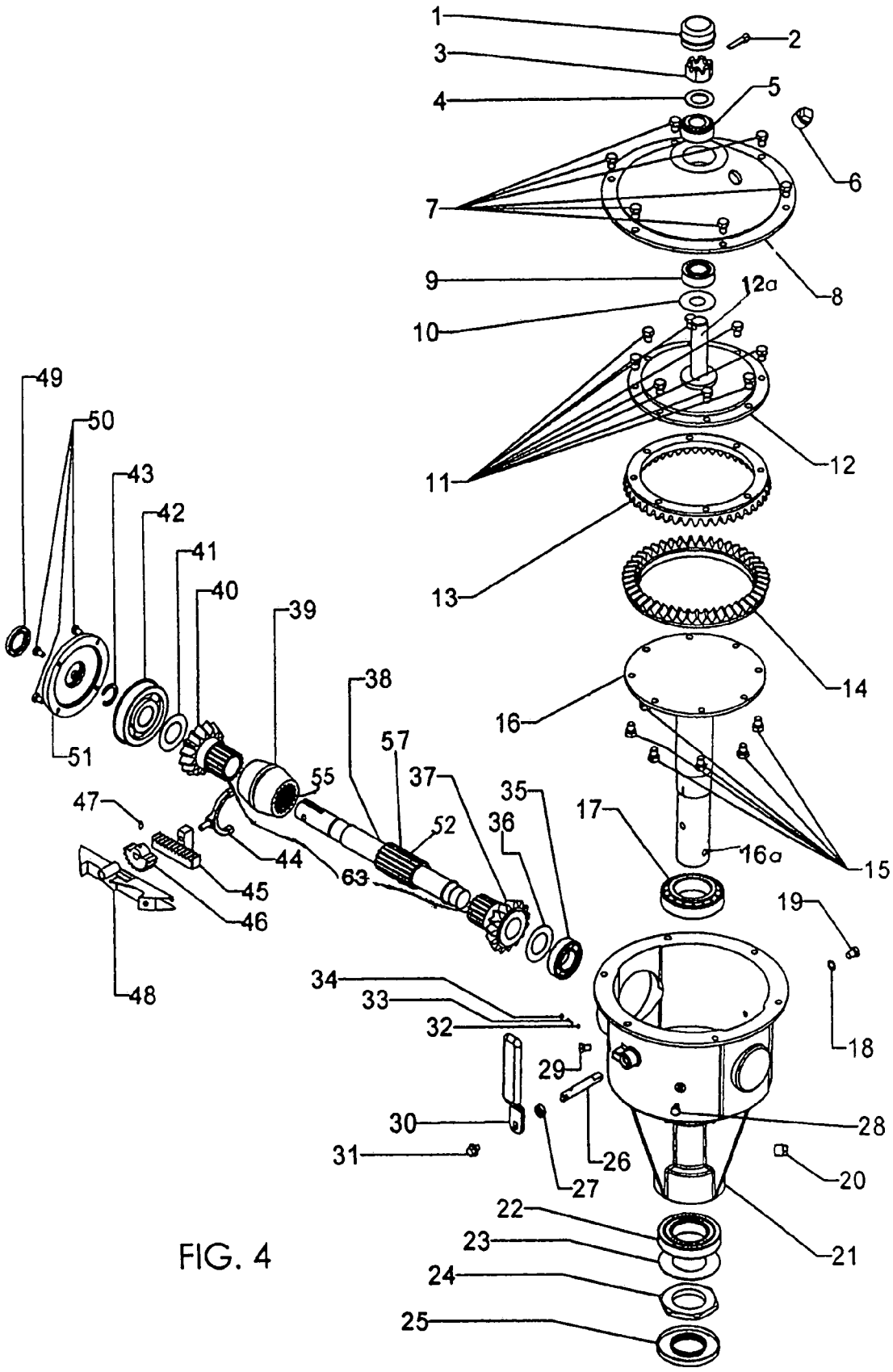
FIG. 4 is an exploded view showing component parts of the gear box disposed in alignment.
Figure 9:
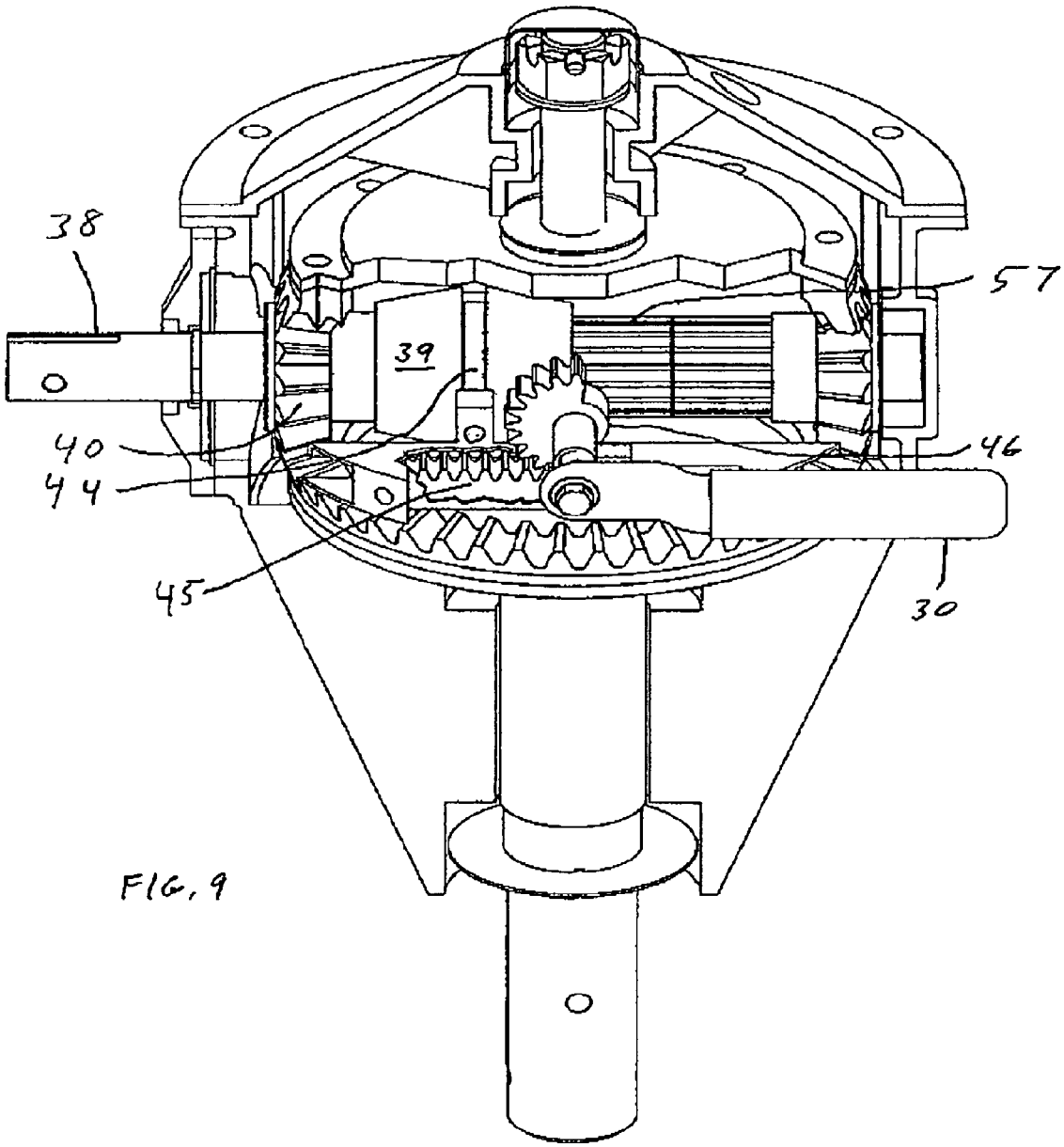
FIG. 9 is a cut-away view taken from a point above and to a side of the power head portion of my new reversible post hole digger showing engagement of the central shaft with a leftmost pinion gear.

FIG. 3 shows placement of a rack and pinion subassembly by means of which shifting of gears is carried out. Fork 44 (FIG. 4) operates to move slide 39 to engage internal spline slots 55 provided inside the slide with mating external ridges 63 of a pinion gear 37 or 40. As noted above, a central portion 52 of input or main shaft 38 is splined, this splined portion 57 meshing with internal splines 55 of slide 39, providing a neutral position of the auger when the slide is engaged at this central portion of the main shaft. As shown in FIG. 4, the length of slide 39 is approximately the same length as the splined region 57 on main shaft 38. Fork 44 is connected to rack 45, which is intermeshed with pinion gear 46 controlled by gear shift lever 30. A rack gear guide rail 48 is provided to control movement of the rack. A set screw 34, spring 33 and detent ball 32 connected to shifter shaft 26 cooperate to form a detent mechanism that locks a selected pinion gear in place. As shown in FIG. 9, shift handle 30 is moved to the right, which in turn rotates pinion gear 46 clockwise. This rotation of pinion gear 46 moves rack gear 45 to the left, causing shift fork 44 to move slide 39 to the left. In this position, slide 39 bridges the splines of the left-most pinion gear 40 and splines 57 of input shaft 38, locking pinion 40 and shaft 38 together.

FIG. 4 is an exploded view showing internal components of the gearbox disposed in alignment. A list of these components and a brief description is as follows:

| Number | Item |
|---|---|
| 1 | dust cap-prevents dust from entering housing |
| 2 | cotter pin-locks castle nut in place |
| 3 | castle nut-secures upper shaft segment in place |
| 4 | spindle washer-distributes pressure from castle nut |
| 5 | upper bearing-upper antifriction bearing for shaft segment |
| 6 | fill plug-oil fill plug |
| 7 | top cover bolts-secure top cover to housing |
| 8 | top cover-rotatably holds upper shaft segment and covers housing |
| 9 | lower bearing-lower antifriction bearing for shaft segment |
| 10 | shim-thickness adjusts lower bearing running clearance |
| 11 | ring gear bolts-secures upper ring gear to upper ring gear plate |
| 12 | upper ring gear plate-fixed to upper shaft segment, holds ring gear in place |
| 12a | upper shaft segment-rotatably supports upper ring gear |
| 13 | upper ring gear-distributes pinion loads |
| 14 | lower ring gear-driven by forward and reverse pinion gears, attached to output shaft |
| 15 | lower ring gear bolts-attaches lower ring gear to lower ring gear plate |
| 16 | lower ring gear plate-interfaces output shaft with lower ring gear |
| 16a | lower output shaft portion-holds post hole auger, driven by lower ring gear |
| 17 | output shaft bearing-antifriction bearing for output shaft |
| 18 | check plug seal-gasket seal for oil check plug |
| 19 | check plug-oil check plug |
| 20 | drain plug-oil drain plug |
| 21 | case-housing for gear train |
| 22 | output shaft bearing-antifriction bearing for output shaft |
| 23 | spindle washer-distributes pressure from spindle nut |
| 24 | spindle nut-secures output shaft in place |
| 25 | oil seal-prevents oil leakage through antifriction bearings |
| 26 | shifter shaft-interfaces shift lever with gear shift pinion gear |
| 27 | oil seal-prevents oil leakage at shifter shaft |
| 28 | guide rail bolt-holds rack gear guide rail in place |
| 29 | guide rail bolt-holds rack gear guide rail in place |
| 30 | shift handle-rotates shifter shaft to shift into forward/reverse |
| 31 | shift handle bolt-secures shifter handle to shifter shaft |
| 32 | detent ball-temporarily locks shifter shaft in selected gear |
| 33 | spring-biases detent ball |
| 34 | set screw-adjusts detent force |
| 35 | input shaft bearing-antifriction bearing for driven input shaft |
| 36 | shim-thickness adjusts running clearance for input shaft bearing |
| 37 | pinion-forward-drives lower ring gear and output shaft holding auger in digging direction |
| 38 | input shaft-receives rotational force and transmits to ring gear via pinion-forward gear |
| 39 | slide-couples power from input shaft to selected pinion |
| 40 | pinion-reverse-drives lower ring gear and output shaft holding auger in reverse |
| 41 | shim-thickness adjusts running clearance for input shaft bearing |
| 42 | input shaft bearing-antifriction bearing for driven input shaft |
| 43 | C-clip-prevents input shaft from moving longitudinally |
| 44 | shift fork-interfaces rack gear with slide |
| 45 | rack gear-interfaces shift fork with pinion gear |
| 46 | pinion gear-moves rack gear to select forward/reverse |
| 47 | set screw-fixes shifter shaft to pinion gear |
| 48 | rack gear guide rail-guides motion of rack gear |
| 49 | front oil seal-prevents oil leakage through front cover |
| 50 | front cover bolts-secure front cover to case |
| 51 | front cover-provides access to input shaft and bearings |

Figure 5:
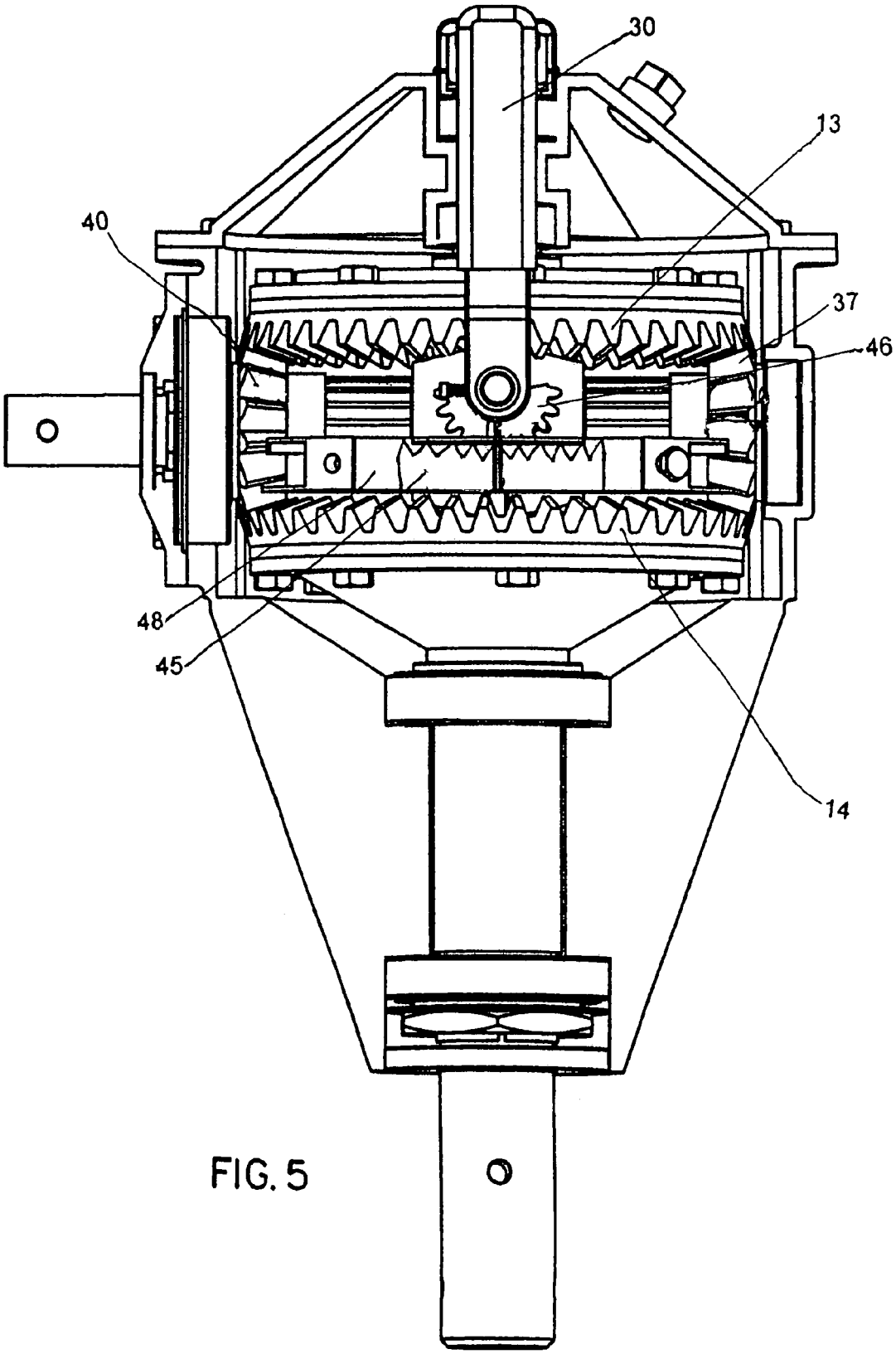
FIG. 5 is a front view of the gearbox, with cover removed, showing placement of ring gears and pinions.

FIG. 5 shows upper ring gear 13, lower ring gear 14, forward pinion 37 and reverse pinion gear 40 in a neutral position owing to shift handle 30 being placed in an upright position. Upon moving the handle to the left or right, the selected pinion gear 37 or 40 would be moved to bridge the splines between the splines of the main shaft and splines of a selected pinion, causing the output shaft ad auger to be rotated in a forward or reverse direction. This view also shows rack gear guide rail 48, partly broken away to show rack gear 45 which is engaged by pinion 46.

Figure 6:
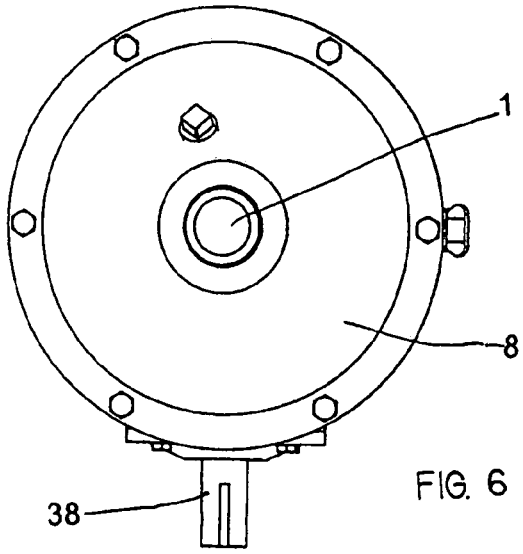
FIGS. 6, 7 and 8 are top, front and side external views of the power head/gear box.
Figure 7:
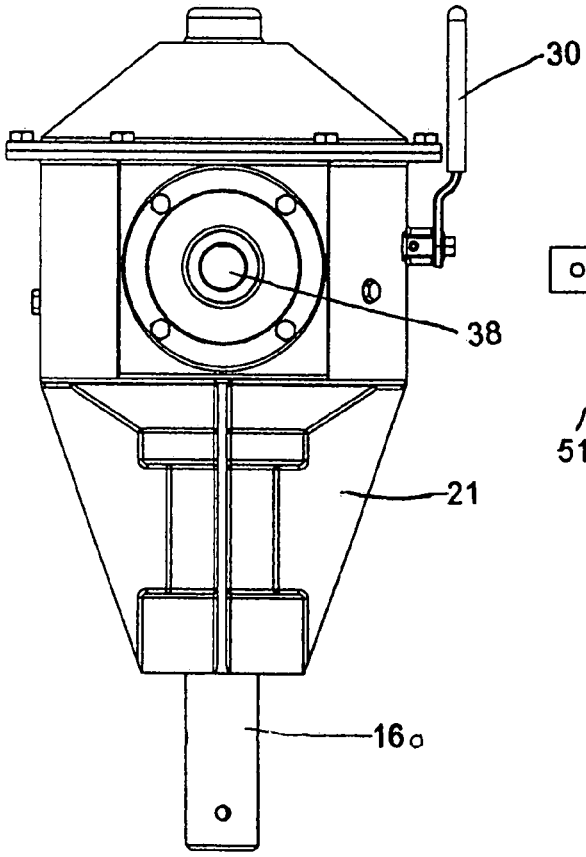
Figure 8:
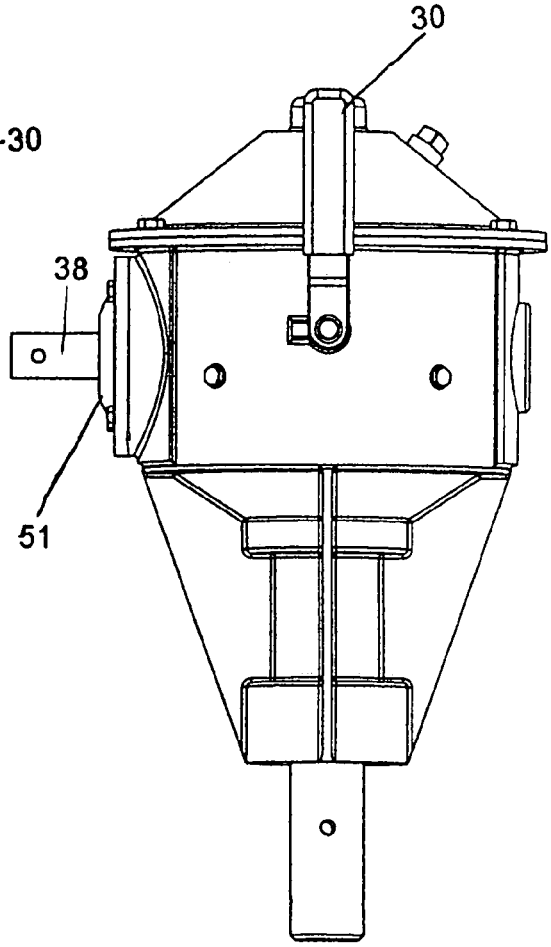

FIGS. 6, 7 and 8 respectively provide external views of the power head/gear box assembly from the top, front and side. FIG. 6 shows a top cover 8 having a dust cap 1 in the center. An outer end of input shaft 38 extends outward for connection with a power takeoff shaft 54 which drives an auger 56.

A reversible post hole digger designed from the start for being carried in a single housing provides significant advantages over approaches in which reversibility is obtained by connecting an existing one-way digger with external components of an after-market kit. Inclusion of a second ring gear integrated into a single transmission enables a stronger and simpler apparatus by compensating for thrust developed by a single ring and pinion gear such as currently found in the prior art.

While the invention is described above in terms of a preferred embodiment, it is not to be understood as being limited to such an embodiment, but is limited only as indicated by the appended claims.

The invention claimed is:

1. A reversible-auger post hole digger apparatus driven by a power takeoff comprising:

a housing;

a main input shaft rotatably positioned within and across said housing;

a pair of pinion gears carried by opposite ends of said main input shaft;

a central portion of said shaft being provided with an external engageable component;

a slide disposed on said shaft between said pinion gears and including an internal engaging component adapted for engaging either one of said pinion gears or said central portion of said shaft in order to obtain a selected forward, reverse or neutral position;

a mechanism for moving said slide to one of said selected forward, reverse or neutral position;

a pair of ring gears mounted at upper and lower positions and engaged with said pair of pinion gears;

an output shaft driven by one ring gear of the pair of ring gears in both forward and reverse directions and extending from said housing, and an auger connected to said output shaft.

2. The apparatus as defined in claim 1 wherein the other ring gear of said pair of ring gears is connected to a shaft segment coaxial with and disposed apart from said output shaft.

3. The apparatus as defined in claim 2 including a lower plate connected to an inner end of said output shaft and an upper plate connected to an inner end of said shaft segment.

4. The apparatus as defined in claim 3 wherein said lower plate and said upper plate are circular.

5. The apparatus as defined in claim 4 including bolts connecting said lower plate and said upper plate to a back side of a respective said ring gear.

6. The apparatus as defined in claim 1 wherein said mechanism for moving said slide comprises a fork having a pair of arms grasping opposite sides of the slide at a circumferential groove defined therein, a rack connected to said fork, said rack mounted for sliding movement parallel with said main input shaft, a rack-engaging pinion gear supported for rotation by said housing and intermeshed with said rack, and a gear shift connected to said pinion external to said housing.

7. The apparatus as defined in claim 6 including a guide rail to control movement of said rack.

8. The apparatus as defined in claim 7 wherein said rack-engaging pinion gear has a generally semicircular structure.

9. The apparatus as defined in claim 8 including bearings positioned at end portions of said output shaft, said main input shaft and said shaft segment.

10. The apparatus as defined in claim 9 wherein said housing has an upper body portion generally parallel with said output shaft and a plurality of supporting gussets extending angularly downward from the upper body portion.

11. A reversible post hole digger driven by a powered shaft, said reversible post hole digger comprising:

a housing;

an input power shaft connectable to and driven by said powered shaft, said input power shaft extending across an interior of said housing and supported for rotation by said housing, with a central portion of said input power shaft within said housing being an externally splined central region;

a pair of pinion gears supported for rotation on said input power shaft and within said housing, one pinion gear of said pair of pinion gears carried on one side of said splined central region and the other pinion gear of said pair of pinion gears carried on the other side of said splined central region, each pinion gear of said pair of pinion gears configured having an externally splined region adjacent said externally splined central region of said input power shaft;

a slide having internal splines and mounted for movement along said splined central region of said input power shaft and said splined region of a respective pinion gear of said pair of pinion gears, said slide being of a length so as to bridge said splined central region and said splined region of one pinion gear or the other pinion gear of said pair of pinion gears, a mechanism for moving said slide to a position bridging said splined region of a respective pinion gear of said pair of pinion gears or to position said slide at said splined central region of said main input shaft;

a first ring gear supported for rotation in said housing above said pair of pinion gears and in continuous geared engagement with both of said pair of pinion gears, and a second ring gear supported for rotation by said housing below said pair of pinion gears and in continuous geared engagement with both of said pair of pinion gears, said second ring gear connected to an output shaft, a posthole auger connected to said output shaft.

12. The reversible posthole digger as set forth in claim 11 wherein said slide is a tubular, internally splined slide.

13. The reversible post hole digger as set forth in claim 12 wherein said tubular, internally splined slide is approximately a length of said splined central region.

14. The reversible posthole digger as set forth in claim 12 wherein said mechanism further comprises;

an engagement on an exterior of said slide, an engagement linkage coupled to said engagement on said slide, a lever external to said housing and coupled to said engagement linkage, whereby movement of said lever moves said slide to bridge said exterior splined region of one pinion gear of said pair of pinion gears with said splined central region, or to position said slide at said splined central region.

15. The posthole digger as set forth in claim 14 wherein said engagement further comprises a circumferential groove on an exterior of said slide, and said engagement linkage further comprises at one end a forked member having fingers extending into said groove, and at opposite end a connection for said lever.

16. The reversible post hole digger as set forth in claim 11 wherein said powered shaft further comprises a power takeoff of a tractor, with said housing in a 3 point hitch connected to said tractor.

17. The reversible posthole digger as set forth in claim 14 wherein said mechanism further comprises:

a rack adjacent said slide and supported for movement parallel with said man input shaft, said opposite end of said engagement linkage coupled to said rack, a rack-engaging pinion gear connected to said lever so that rotation of said rack-engaging pinion gear moves said rack and said external engagement member to move said slide along said splines of said central splined region and said splines of one of said pinion gears of said pair of pinion gears.

18. The posthole digger as set forth in claim 11 wherein said first ring gear is mounted to a stub shaft in an upper portion of said housing, said stub shaft being coaxial with said output shaft.

19. A post hole digger couplable to a three point hitch of a tractor, and operated by a power take off shaft from said tractor, said post hole digger comprising:

a housing, a power input shaft having a splined central region and coupled to said power takeoff shaft, said power input shaft supported for rotation at opposed sides of said housing, a first pinion gear supported for rotation on said power input shaft on one side of said splined central region, a second pinion gear supported for rotation on said power input shaft on the opposite side of said splined central region, said first and second pinion gears each having a splined region adjacent said splined central region, a first ring gear supported for driven rotation by one of said first pinion gear and said second pinion gear, said first ring gear in permanent geared engagement with both said first pinion gear and said second pinion gear, a second ring gear supported for driven rotation by one of said first pinion gear and said second pinion gear, said second pinion gear in permanent geared engagement with said first pinion gear and said second pinion gear, an internally splined, generally tubular slide mounted for sliding engagement with said splined central region and said splined region of each of said first pinion gear and said second pinion gear, a selecting mechanism for moving said slide to bridge said splined central region with said splined region of one of said first pinion gear and said second pinion gear wherein when said first pinion gear is bridged with said splined central region said post hole digger operates in a forward direction and when said second pinion gear is bridged with said splined central region said post hole digger operates in a reverse direction, a post hole digging auger coupled to said second ring gear.

20. The post hole digger as set forth in claim 19 wherein said selecting mechanism comprises:

an external circumferential groove in said slide, a fork having fingers fitted in said groove, a rack supported for movement parallel with said power input shaft, said fork mounted to said rack, a rack pinion gear supported for rotation by said housing, and gearably engaging said rack, a lever connected to said rack pinion gear, for moving said slide via said rack pinion gear, said rack and said fork to select a forward, reverse or neutral operating position of said slide.

* * * * *